US010051382B2

(12) United States Patent
Fischer et al.

(10) Patent No.: US 10,051,382 B2
(45) Date of Patent: Aug. 14, 2018

(54) METHOD AND APPARATUS FOR NOISE SUPPRESSION BASED ON INTER-SUBBAND CORRELATION

(71) Applicant: SIVANTOS PTE. LTD., Singapore (SG)

(72) Inventors: Eghart Fischer, Schwabach (DE); Ulrich Kornagel, Erlangen (DE); Rainer Martin, Bochum (DE); Henning Puder, Erlangen (DE); Alexander Schasse, Bochum (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/003,854

(22) Filed: Jan. 22, 2016

(65) Prior Publication Data

US 2016/0219381 A1 Jul. 28, 2016

(30) Foreign Application Priority Data

Jan. 22, 2015 (DE) ..... 10 2015 201 073

(51) Int. Cl.
*H04R 25/00* (2006.01)

(52) U.S. Cl.
CPC ..... *H04R 25/453* (2013.01); *H04R 25/505* (2013.01); *H04R 2225/41* (2013.01); *H04R 2225/43* (2013.01); *H04R 2430/03* (2013.01)

(58) Field of Classification Search
CPC ..... H04R 24/453; H04R 25/505; H04R 2225/41; H04R 2225/43; H04R 2430/03
USPC ..... 381/317
See application file for complete search history.

(56) References Cited

U.S. PATENT DOCUMENTS

| | | | | |
|---|---|---|---|---|
| 7,720,235 | B2 * | 5/2010 | Abe | G10L 19/02 381/94.3 |
| 8,107,656 | B2 | 1/2012 | Dreßler et al. | |
| 8,634,581 | B2 | 1/2014 | Rosenkranz | |
| 8,948,424 | B2 | 2/2015 | Gerkmann et al. | |
| 9,031,259 | B2 * | 5/2015 | Yamabe | G10L 21/0216 381/92 |
| 9,124,963 | B2 | 9/2015 | Martin et al. | |
| 2004/0252853 | A1 * | 12/2004 | Blamey | H04R 3/002 381/318 |

(Continued)

FOREIGN PATENT DOCUMENTS

| | | | |
|---|---|---|---|
| DE | 102006051071 | A1 | 5/2008 |
| DE | 102010026884 | A1 | 1/2012 |

(Continued)

*Primary Examiner* — Sean H Nguyen
(74) *Attorney, Agent, or Firm* — Laurence A. Greenberg; Werner H. Stemer; Ralph E. Locher

(57) ABSTRACT

A method performs noise suppression in hearing aids. A step of the method involves a first audio signal being split into a plurality of essentially disjunct frequency bands. A further step of the method involves a reference band being selected from the plurality of frequency bands, which reference band has an establishable first component of a speech signal. Another step involves a correlation between the reference band and a first frequency band being ascertained. A further step involves a value that indicates a second component of a speech signal in the first frequency band being ascertained on the basis of the correlation. Another step of the method involves a noise suppression being set in the first frequency band on the basis of the ascertained value.

13 Claims, 3 Drawing Sheets

(56) References Cited

U.S. PATENT DOCUMENTS

| | | | | |
|---|---|---|---|---|
| 2005/0078842 | A1* | 4/2005 | Vonlanthen | H04R 25/43 381/312 |
| 2007/0195973 | A1 | 8/2007 | Kaulberg | |
| 2010/0220879 | A1* | 9/2010 | Feilner | H04R 25/70 381/314 |
| 2011/0002473 | A1* | 1/2011 | Nakatani | H04B 3/20 381/66 |
| 2013/0195302 | A1* | 8/2013 | Meincke | G10L 21/02 381/321 |
| 2013/0216062 | A1* | 8/2013 | Martin | H04R 25/505 381/74 |
| 2013/0231932 | A1* | 9/2013 | Zakarauskas | G10L 25/78 704/236 |

FOREIGN PATENT DOCUMENTS

| | | | |
|---|---|---|---|
| DE | 102011004338 | B3 | 7/2012 |
| DE | 102012202469 | B3 | 1/2013 |

* cited by examiner

METHOD AND APPARATUS FOR NOISE SUPPRESSION BASED ON INTER-SUBBAND CORRELATION

CROSS-REFERENCE TO RELATED APPLICATION

This application claims the priority, under 35 U.S.C. § 119, of German application DE 10 2015 201 073.2, filed Jan. 22, 2015; the prior application is herewith incorporated by reference in its entirety.

BACKGROUND OF THE INVENTION

Field of the Invention

The invention relates to a method for suppressing noise in hearing aids and to a corresponding hearing aid. In this case, incoming audio signals are split into frequency bands.

Hearing aids are portable hearing apparatuses that are used for looking after people with impaired hearing. In order to meet the numerous individual needs, different designs of hearing aids are provided, such as behind the ear hearing aids (BTE), hearing aid with an external receiver (RIC: receiver in the canal) and in the ear hearing aids (ITE), e.g. including concha hearing aids or canal hearing aids (ITE, CIC). The hearing aids listed by way of example are worn on the outer ear or in the auditory canal. Furthermore, there are also bone conduction hearing aids, implantable or vibrotactile hearing aids available on the market, however. These involve the damaged hearing being stimulated either mechanically or electrically.

Hearing aids basically have the essential components of an input transducer, an amplifier and an output transducer. The input transducer is normally an acoustoelectric transducer, e.g. a microphone, and/or an electromagnetic receiver, e.g. an induction coil. The output transducer is generally in the form of an electroacoustic transducer, e.g. a miniature loudspeaker, or in the form of an electromechanical transducer, e.g. a bone conduction receiver. The amplifier is usually integrated in a signal processing device. The power supply is usually provided by a battery or a rechargeable storage battery.

For people with decreased hearing capacity, particularly speech comprehension is difficult with a high level of ambient noise, since the natural mechanisms for selection of particular sound sources in the signal processing in the brain are not effective, or are effective only to a decreased extent, owing to an input signal from the ear having decreased frequency range and dynamic range.

It is therefore necessary for the hearing aid to undertake some of these functions. In this case, it is already known practice for noise to be masked out by a directional characteristic, for example, or reduced using its spectral properties from an input signal from the microphones.

This also involves the use of adaptive filters that estimate or predict properties of a noise and filter a correspondingly estimated signal out of the input signal. Such methods are known, by way of example, from the publications by Rainer Martin, entitled "Noise Power Spectral Density Estimation Based on Optimal Smoothing and Minimum Statistics", IEEE TRANSACTIONS ON SPEECH AND AUDIO PROCESSING, VOL. 9, NO. 5, July 2001, and by Timo Gerkmann and R. C. Hendriks, entitled "Unbiased MMSE-based Noise Power Estimation with Low Complexity and Low Tracking Delay", IEEE TRANSACTIONS ON SPEECH AND AUDIO PROCESSING, VOL. 20, NO. 4, pages 1383-1393, May 2012. These documents describe how energy of a spurious signal can be estimated from an observation of temporal minima in an input signal.

However, in the case of speech, which contains a high dynamic range having fast changes, such noise suppression can result in undesirable artifacts that interfere with speech intelligibility.

SUMMARY OF THE INVENTION

It is therefore the object of the present invention to provide a hearing aid and a method for operating a hearing aid that improve speech comprehension given noise suppression.

The invention achieves this object by means of a method for operating a hearing aid and a hearing aid.

The method according to the invention for noise suppression in hearing aids has the step of splitting an audio signal into a plurality of essentially disjunct frequency bands.

In this case, the audio signal can originate from one or more microphones, a signal input or a wireless transmission device. The signal may be analog or digital in this case. The splitting into frequency bands can be effected using one or more filter means, for example a filter bank, a plurality of discrete filters or by virtue of transformation into a frequency space. In this case, essentially disjunct is intended to be understood to mean that the individual frequency bands overlap only to a small extent or not at all, for example by no more than one quarter, one tenth or one twentieth of their bandwidth.

One step of the method according to the invention involves a reference band from the plurality of frequency bands being selected that has an established first component of a speech signal.

In this case, it is conceivable for the hearing aid to have means for recognizing a speech component. The means can recognize the speech component on the basis of a spectral distribution, temporal dynamics, but also on the basis of a source direction for the audio signals picked up by a plurality of microphones in a hearing aid. A control section of the hearing aid can use this means to select a frequency band having a speech component as reference band.

One step of the method according to the invention involves the hearing aid ascertaining a correlation between a first frequency band and the reference band. This can be affected using a device for ascertaining a correlation, for example.

One step of the method according to the invention involves a value being ascertained on the basis of the ascertained correlation, which value indicates a second component of a speech signal in the first frequency band. This can be affected by the control section, for example. In this case, it is conceivable for a strong correlation between the first frequency band and the reference band to be able to be taken as a basis for inferring that the first frequency band also has a signal component containing speech. However, it is also conceivable for the first frequency band likewise to be rated with a means for recognizing a speech component. It is also possible for the means for recognizing a speech component to be applied only to the first frequency band when a sufficiently high correlation with the first frequency band has been ascertained.

A further step of the method according to the invention involves noise suppression in the first frequency band being set on the basis of the ascertained values.

The method according to the invention advantageously allows the noise suppression in the individual frequency bands to be made dependent on whether the frequency bands have a speech signal component. It is thus conceivable for no or just a reduced noise suppression to be applied when speech is present so as not to impair the intelligibility of the latter through artifacts.

Furthermore, the selection of a reference band allows recognition of the speech preferably in frequency ranges where this is simpler, e.g. owing to the speech spectrum, and transfer of the result also to other channels having a smaller component, in which channels this is more difficult, by using the correlation with the first frequency range to confirm the presence of a speech component.

In one conceivable embodiment, the method according to the invention having the steps of ascertainment of a correlation, ascertainment of a value and setting of noise suppression is carried out for a plurality of first frequency bands in parallel or sequentially.

It is thus advantageously possible to suppress a noise over a relatively large frequency range.

In one possible embodiment, the method according to the invention is repeated and, in so being, carried out with a second reference band. In this case, it is conceivable for the second reference band to be the same as the first reference band or to be different than the first reference band.

The use of different reference bands at different times allows the hearing aid to be matched to different situations with different speakers having different pitches and allows the speech to be reliably recognized under different conditions.

In one possible embodiment of the method according to the invention, a reference band is selected by selecting the frequency band having the highest energy in comparison with the other frequency bands from the plurality of frequency bands. In this case, the energy over the square of the amplitude is equivalent to the amplitude of the signal in the frequency band.

A single voice has, e.g. in the case of vowels, a high energy density in a narrow frequency range, which means that a voice component in a frequency band having high energy is probable.

In one conceivable embodiment of the method according to the invention, a reference band is selected by selecting the frequency band having a greatest degree of modulation in a predetermined frequency range.

A high degree of modulation in a frequency band indicates speech activity in this frequency band and can be ascertained with low processor load. A consideration of the degree of modulation in a frequency range that e.g. is characteristic of the modulation frequency of speech allows recognition certainty to be increased. In the method according to the invention, it is thus conceivable, by way of example, to evaluate a degree of modulation in a predetermined frequency range using speech modulation between 1 hertz and 5 or 10 hertz for speech recognition.

In one conceivable embodiment of the method according to the invention, the correlation between the first frequency band and the reference band is ascertained on the basis of signal amplitude or signal energy of a signal in the first frequency band and reference band.

The signal amplitude or the signal energy in the first frequency band and the reference band can be taken as a basis for ascertaining the correlation in a particularly simple manner.

In one possible embodiment of the method according to the invention, the correlation between the first frequency band and the reference band is ascertained on the basis of a degree of modulation of a signal in the first frequency band and reference band in a predetermined frequency range. By way of example, it is thus conceivable, in the method according to the invention, to use a degree of modulation having, in a predetermined frequency range, a speech modulation between 1 hertz and 5 or 10 hertz for determining the correlation.

High modulation is characteristic of speech. Therefore, the correlation of the instantaneous degree of modulation or the degree of modulation determined over a concurrent window affords reliable recognition of whether there is a speech component in the first frequency band too.

In one conceivable embodiment of the method according to the invention, the correlation is ascertained over a window length on the basis of the first audio signal.

The correlation must always be ascertained over a certain number of values that indicate a certain period in the waveform of the signals. This period or the number of values is also called window length. In this case, it may be advantageous to alter this window length on the basis of the environment and hence the first audio signal. By way of example, the fast changes in the input signal thus require the window length to be reduced in order to be able to react more quickly to changes of environment with the noise suppression.

In one possible embodiment of the method according to the invention, a value for a speech component of a signal is ascertained by comparing the correlation with a predetermined threshold value.

The reference band is selected in the method according to the invention such that it preferably has a speech component. If the first frequency band has a correlation with a sufficiently high value, that is to say that the reference band and the first frequency band have features sufficiently common, it can advantageously be assumed that the first frequency band also has speech components.

In one conceivable embodiment of the method according to that invention, a parameter of the noise suppression is set that is a parameter for influencing a spurious signal estimate, a parameter for setting the level of the spurious signal suppression or a parameter for limiting a spurious signal suppression.

Advantageously, the noise suppression in a frequency band can thus be set on the basis of an established speech component such that noise is preferably suppressed and speech components remain as uninfluenced as possible.

The embodiments of the hearing apparatus according to the invention on which the method according to the invention can be carried out share the advantages of this method.

Other features which are considered as characteristic for the invention are set forth in the appended claims.

Although the invention is illustrated and described herein as embodied in a method and an apparatus for noise suppression based on inter-subband correlation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
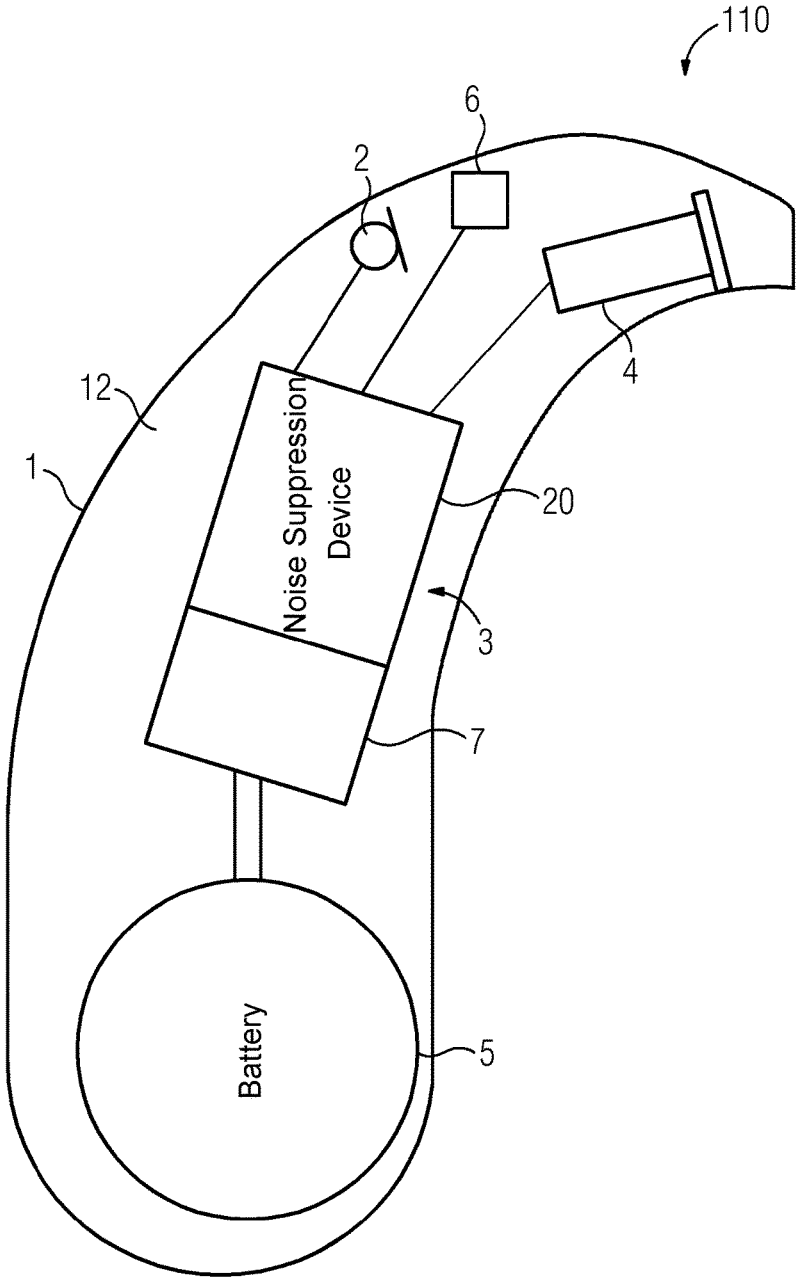
FIG. 1 is a schematic illustration of a hearing aid according to the invention.

Referring now to the figures of the drawings in detail and first, particularly to FIG. 1 thereof, there is shown a basic design of a hearing aid 110 according to the invention. A hearing aid housing 1 for wearing behind the ear contains one or more electroacoustic transducers 2 for picking up the sound or audible signals from the environment. The acoustoelectric transducers 2 are microphones for converting the sound into an electrical input signal, for example. The hearing aid 110 may also have a pickup device 6 for picking up an electrical or electromagnetic signal and converting it into an electrical input signal. A signal processing device 3, which is likewise integrated in the hearing aid housing 1, processes the first electrical signals and, to this end, is connected for signaling purposes to the microphone and/or the pickup device 6. The output signal from the signal processing device 3 is transmitted to a loudspeaker or receiver 4 that outputs an acoustic signal. The sound is transmitted to the eardrum of the device wearer, possibly via a sound tube that is fixed in the auditory canal with an ear mold. Besides the electroacoustic transducers, other electromechanical transducers, such as bone conduction receivers, are also conceivable. The power supply for the hearing aid, and particularly that for the signal processing device 3, is provided by a battery 5 that is likewise integrated in the hearing aid housing 1.

Furthermore, the hearing aid 110 according to the invention has a noise suppression device 20 that, as shown in FIG. 1, is part of the signal processing device 3 or else is also embodied as a separate noise suppression device 20 in the hearing aid 110. The further signal processing functions of the signal processing section 3 are shown as block 12. The noise suppression device 20 is connected for signaling purposes to the microphone 2 and the pickup apparatus 6. The noise suppression device 20 is configured to decrease a noise in the first electrical signal.

Figure 2:
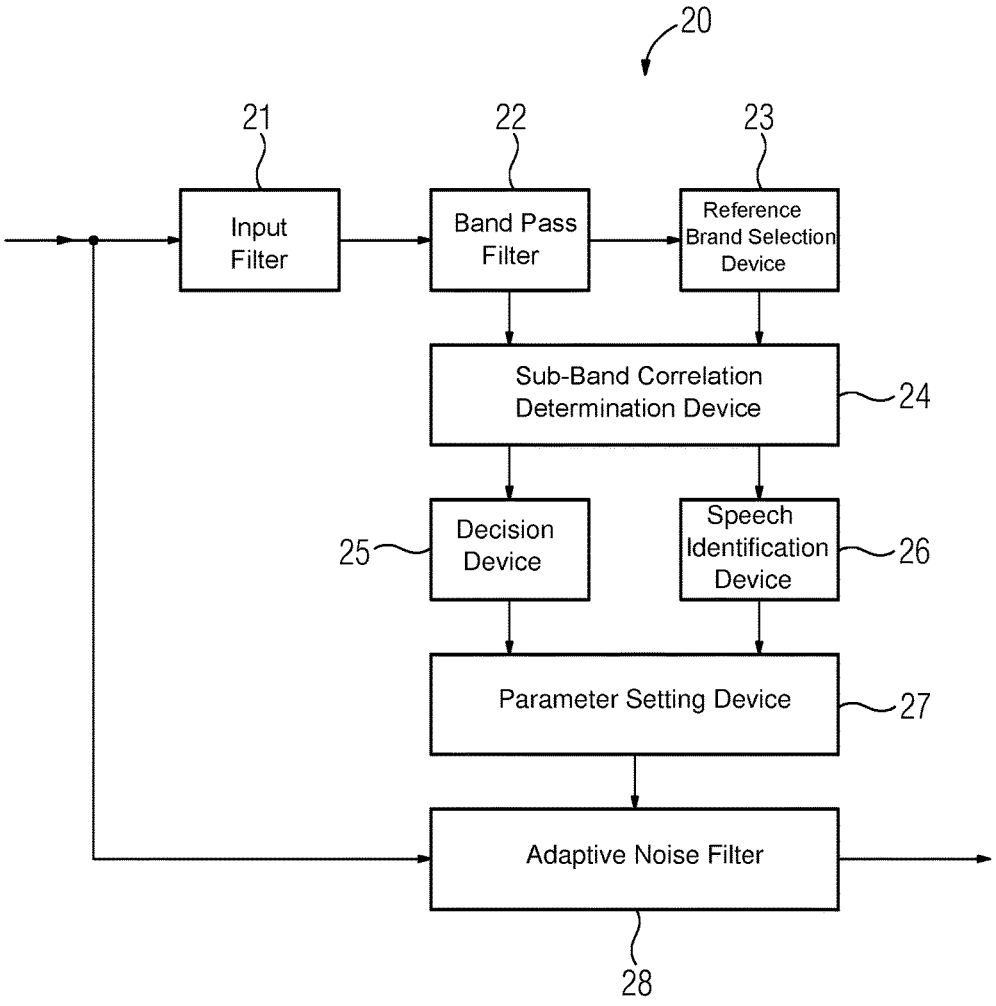
FIG. 2 is a block diagram of a noise suppression device according to the invention.

One possible embodiment of a noise suppression device 20 is shown in more detail in function blocks in FIG. 2. In this embodiment, the electrical input signal from a microphone or from the pickup device 6 is split into a plurality of signals having essentially disjunct frequency changes by the signal processing device 3 itself before being supplied to the noise suppression device 20. This essentially means that the frequency bands do not or only slightly overlap. The noise suppression device 20 shown in FIG. 2 is provided in the hearing aid 110 multiple times for different frequency bands, but shown just for a single frequency band in FIG. 2. By way of example, the multiple noise suppression can be effected by multiple parallel function units or by sequential handling for the individual frequency bands using one functional unit.

In the embodiment shown in FIG. 2, an input filter 21 provides an envelope of a first, single frequency band and a band pass filter 22 limits the frequency thereof to a range that is characteristic of speech in order to facilitate the subsequent steps. These are typical modulation frequencies between 1 hertz and 5 or even 10 hertz. Alternatively, it is conceivable for no separate conditioning to take place or for this to take place in another way. Equally, it is conceivable for characteristic features of speech other than the modulation frequency to be subsequently used, for example a spectral energy distribution or dynamic variations.

A reference band selection device 23 selects a reference band from the plurality of frequency bands. To this end, the reference band selection device 23 indicated in FIG. 2 is connected for signaling purposes (not shown) to other reference band selection devices for other frequency bands or as part of a reference band selection device 23 that spans frequency bands. In this case, it is always possible to select one and the same frequency band as reference band, which is in a frequency range that is typical of speech, for example. However, it is also conceivable for a reference band that has features characteristic of speech, for example, to be selected dynamically for a variable period of time. The features may be, inter alia, dynamic fluctuations with a typical dynamic range or with a typical fluctuation frequency that are below 10, 5 or 2 hertz, for example. Preferably, the correlation determination described below takes place for the selected reference band and at least one further, different frequency band.

A sub-band correlation determination device 24 is supplied with the signal in the reference band and also at least in a different frequency band, the connection for signaling purposes not being shown in FIG. 2. Usually, the different frequency band is the first frequency band supplied to the noise suppression device 20, if it is not the reference band itself. The sub-band correlation determination device 24 determines a value for a correlation between the reference band and the first frequency band. In this case, the correlation between the reference band and the first frequency band can be determined by a correlation algorithm, as described in Wikipedia, for example, under the headword "Korrelations-Koeffizient" or the link http://de.wikipedia.org/w/index.php?title=Korrelationskoeffizient&oldid=119844810.

As a result, the sub-band correlation determination device 24 preferably delivers, by means of the speech identification device 26, a value for a probability of the signal in the first frequency band having a speech component. Alternatively, or additionally, the sub-band correlation determination device 24 can also use a decision device 25 to deliver a binary signal for whether the first frequency band has a speech signal. It is thus possible to simplify the subsequent handling when the first frequency band has no speech components.

A parameter setting device 27 takes the binary signal and/or the probability value as a basis for ascertaining suitable parameters for an adaptive noise filter 28. In the simplest case, the gain of the adaptive noise filter 28 can be set to zero if there is no speech component in the first frequency band. It is also conceivable for the gain to be proportional to or otherwise dependent on the probability value. It is also possible for other parameters of the adaptive noise filter 28 to be set in another way on the basis of the binary signal and/or the probability signal. It would thus be possible to adjust the step size for adaptive adjustment of the filter, e.g. a Wiener filter.

The adaptive noise filter 28 takes the parameter setting as a basis for preferably reducing a component of noise in comparison with speech components in the first frequency band.

Figure 3:
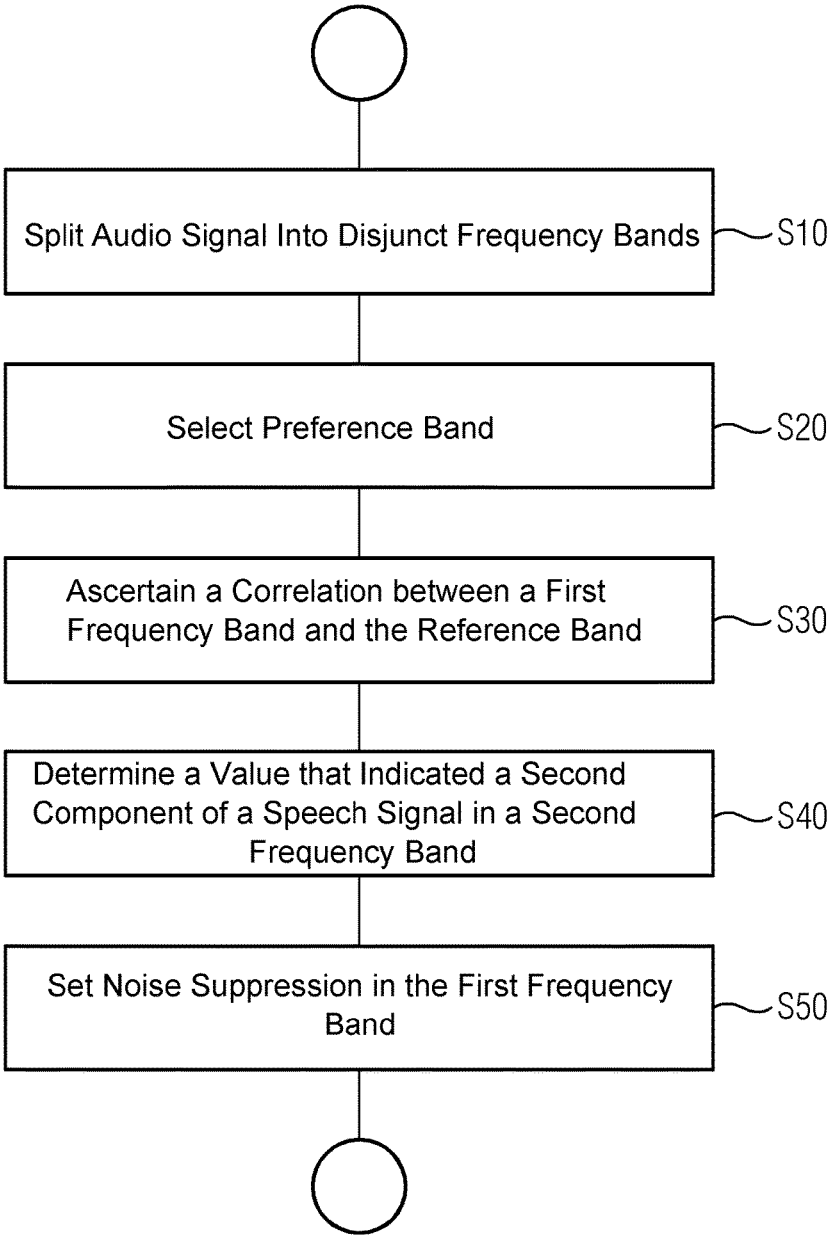
FIG. 3 is flow chart for explaining a method according to the invention.

FIG. 3 shows a schematic flowchart for a method according to the invention.

A step S10 involves an audio signal being split into a plurality of essentially disjunct frequency bands.

In this case, the audio signal preferably originates from one or more microphones, but the source may also be an electrical signal input or a wireless transmission device, for example. The splitting into subbands can be effected using one or more filter devices, for example a filter bank, a plurality of discrete filters or through transformation into a frequency space. In this case, essentially disjunct is intended to be understood to mean that the individual frequency bands overlap only to a small degree or not at all, for example by no more than one quarter, one tenth or one twentieth of their bandwidth.

A step S20 of the method according to the invention involves a first frequency band for the plurality of frequency bands being selected as a reference band, which has an establishable first component of a speech signal.

In this case, it is conceivable for the hearing aid to have a device for recognizing a speech component. This device may be the reference band selection device shown in FIG. 2. Possible devices can recognize a speech component on the basis of a spectral distribution, temporal dynamics, but also on the basis of a source direction for the audio signals picked up by a plurality of microphones of a hearing aid. A control section or the reference band selection device 23 of the hearing aid can therefore select a frequency band having a speech component as reference band. Alternatively, it is conceivable for the device for selection to take a preset as a basis for selecting a particular frequency band that is typical of speech.

A step S30 of the method according to the invention involves the hearing aid ascertaining a correlation between the first frequency band and the reference band. By way of example, this can be affected using the subband correlation determination device 24. Methods for determining a correlation are specified in the description relating to FIG. 2.

Usually, the first frequency band is a different frequency band than the reference band. In the case of parallel or sequential handling of all the frequency bands by means of steps S30 to S50, however, it is also possible for the first frequency band to be identical to the reference band. The correlation value is then at a maximum owing to the identity.

A step S40 of the method according to the invention involves the decision device 25 and/or the speech identification device 26 taking the ascertained correlation as a basis for determining a value that indicates a second component of a speech signal in the second frequency band. This may be a binary value, a "binary mask" or even a fuzzy value, for the purposes of fuzzy logic, which indicates a probability. In this case, it is conceivable for a strong correlation between the first frequency band and the reference band to be able to be taken as a basis for inferring that the first frequency band also has a signal component having speech. However, it is also conceivable for the first frequency band likewise to be rated using a device for recognizing a speech component. It is also possible for the speech identification device 26 to be applied only to the first frequency band if sufficiently high correlation with the first frequency band has been ascertained and the decision device 25 assumes a corresponding value as "binary mask".

A step S50 of the method according to the invention involves a noise suppression being set in the first frequency band on the basis of the ascertained value. In the simplest case, the gain of the noise filter 28 can be set to zero if there is no speech component in the first frequency band. It is also conceivable for the gain to be proportional to or otherwise dependent on the probability value. It is also possible for other parameters of an adaptive noise filter to be otherwise set on the basis of the binary signal and/or the probability signal. It would thus be possible to adjust the step size for adaptive adjustment of the filter, e.g. a Wiener filter, or the maximum possible cut.

The adaptive noise filter takes the parameter setting as a basis for preferably reducing a component of noise in comparison with speech components in the first frequency band.

Preferably, steps S30 to S50 are carried out for all the frequency bands from the plurality of frequency bands either in parallel or sequentially one after the other.

In a preferred embodiment, according to the invention, of the method, steps S10 to S50 are repeated cyclically at predetermined or variable intervals of time, step S20 being able to be carried out only once or likewise being repeated with a variable reference band. Within these repetitions, steps S30 to S50 are then preferably carried out for a plurality of or all the frequency bands in parallel or sequentially.

Although the invention has been illustrated and described in more detail by the preferred exemplary embodiment, the invention is not restricted by the disclosed examples and other variations can be derived therefrom by a person skilled in the art without departing from the scope of protection of the invention.

The invention claimed is:

1. A method for noise suppression in hearing aids, which comprises the steps of:

a) splitting a first audio signal into a plurality of disjunct frequency bands;

b) selecting a reference band from the plurality of disjunct frequency bands by using an established first component of a speech signal;

c) ascertaining a correlation between the reference band and a first frequency band, the first frequency band having no overlap with the reference band;

d) ascertaining a value indicating a second component of the speech signal in the first frequency band, on a basis of the correlation; and e) setting the noise suppression in the first frequency band on a basis of an ascertained value.

2. The method according to claim 1, which further comprises carrying out the steps c) to d) for a plurality of first frequency bands.

3. The method according to claim 1, which further comprises repeating the steps a) to e) being carried out with a second, different reference band.

4. The method according to claim 1, wherein the step b) involves the reference band being selected by selecting a frequency band having a highest energy.

5. The method according to claim 1, wherein the step b) involves the reference band being selected by selecting a frequency band having a greatest degree of modulation in a predetermined frequency range.

6. The method according to claim 1, which further comprises ascertaining the correlation between the first frequency band and the reference band on a basis of a signal amplitude or signal energy of a signal in the first frequency band and the reference band.

7. The method according to claim 1, which further comprises ascertaining the correlation between the first frequency band and the reference band on a basis of a degree of modulation of a signal in the first frequency band and the reference band in a predetermined frequency range.

8. The method according to claim 1, wherein the correlation performed in the step c) is made over a window length on a basis of the first audio signal.

9. The method according to claim 1, which further comprise ascertaining the value comparing the correlation with a predetermined threshold value.

10. The method according to claim 1, which further comprises performing the step e) by setting a parameter of the noise suppression which is a parameter for influencing a spurious signal estimate, a parameter for setting a level of a spurious signal suppression or a parameter for limiting a spurious signal suppression.

11. A hearing aid, comprising:

an apparatus for noise suppression containing:

a filter;

a recognition means for recognizing a speech component in an audio signal;

correlation means for determining a correlation between two audio signals;

a noise suppression section having an adjustable parameter; and a control section;

the hearing aid is configured to:

split the audio signal into a plurality of essentially disjunct frequency bands using said filter;

use said recognition means to recognize whether a frequency band contains a first component of a speech signal and to select a frequency band having the first component of the speech signal as reference band;

use said correlation means to determine a correlation between a first frequency band and the reference band, the first frequency band having no overlap with the reference band;

ascertain a value that indicates a second component of the speech signal in the first frequency band; and set a noise suppression in the first frequency band on a basis of an ascertained value by means of said control section.

12. The hearing aid according to claim 11, wherein said recognition means is configured to ascertain a degree of modulation of the frequency band and to take the degree of modulation in a predetermined frequency range as a basis for recognizing the speech component.

13. The hearing aid according to claim 11, wherein said correlation means is configured to ascertain a degree of modulation of the frequency band in a predetermined frequency range and to take the degree of modulation in the first frequency band and the reference band as a basis for ascertaining the correlation between the first frequency band and the reference band.

* * * * *